United States Patent [19]

Minami

[11] 4,242,009

[45] Dec. 30, 1980

[54] APPARATUS FOR AUTOMATICALLY AND SELECTIVELY DISCHARGING SALINE WATER

[75] Inventor: Isao Minami, Kyoto, Japan

[73] Assignee: Michio Okamoto, Kyoto, Japan

[21] Appl. No.: 19,170

[22] Filed: Mar. 9, 1979

[30] Foreign Application Priority Data

Jul. 11, 1978 [JP] Japan ..... 53/83519

[51] Int. Cl.[3] ..... E02B 7/50

[52] U.S. Cl. ..... 405/93; 405/97; 405/104

[58] Field of Search ..... 405/87, 92, 93, 96, 405/97, 103, 104; 137/428, 430, 433

[56] References Cited

U.S. PATENT DOCUMENTS

| | | | |
|---|---|---|---|
| 682,480 | 9/1901 | Meyssonnier | 405/93 X |
| 1,644,445 | 10/1927 | Pratt | 405/96 X |
| 3,289,417 | 12/1966 | Girden | 405/96 |
| 3,908,206 | 9/1975 | Grewing | 137/428 X |
| 4,091,624 | 5/1978 | Steinke | 405/96 |

FOREIGN PATENT DOCUMENTS

| | | | |
|---|---|---|---|
| 7511893 | 4/1977 | Netherlands | 405/97 |

*Primary Examiner*—David H. Corbin

*Attorney, Agent, or Firm*—Fleit & Jacobson

[57] ABSTRACT

An apparatus for automatically and selectively discharging saline water at a tide-preventing floodgate between the ocean and a river or like which comprises a tide-preventing floodgate provided between the ocean and a river or the like, a drainpipe for discharging saline water distributed in a lower portion of said river or the like and disposed on the utmost lower part of said floodgate, a distal end mouth opened at an end portion of said drainpipe to upright direction, a hollow float positioned at the distal end mouth of the drainpipe and supported by at least one support pole for guiding the ascending or descending motion of the hollow float, a communication path provided at a submarine level portion of said floodgate and a flexible communication pipe for communicating the inside of the hollow float with the sea water of downstream through said communication path, whereby said hollow float automatically ascends or descends so as to open or close said end mouth of the drainpipe with respect to a level difference between upstream water level and downstream water level of the floodgate for discharging saline water of the bottom layer portion of the upstream side or preventing sea water of downstream side of the floodgate from flowing into upstream side of the floodgate.

8 Claims, 7 Drawing Figures

APPARATUS FOR AUTOMATICALLY AND SELECTIVELY DISCHARGING SALINE WATER

BACKGROUND OF THE INVENTION

1. Field of the Invention

The present invention relates to an apparatus for automatically and selectively discharging saline water at a tide-preventing floodgate between the ocean and a river, a lake, a canal or the like, more particularly, to a field-type apparatus for automatically and selectively discharging saline water at a tide-preventing floodgate between the ocean and a river or the like, without using any prime mover and in the absence of a controller.

2. Description of the Prior Art

Tide-preventing floodgates are usually provided at places where the ocean contacts with rivers, waterways, canals, lakes or the like to prevent invasion of sea water of the downstream side of the floodgate to river water or the like, thereby to utilize upstream fresh water as water resources. Tide-preventing floodgates have also a function to discharge incoming water from upstream to downstream side of the floodgate, if the incoming water is accumulated too much and incurring a danger of flood damage.

When a water gate is pulled up to discharge accumulated upstream water to downstream or when a gate of accompanied establishment of a tide-preventing floodgate is opened to pass a ship, some sea water flows upstream or invades upstream through the gate. On the upstream side of the gate, there is also saline water coming from the sea water of the downstream through the bottom soil by penetration. Therefore, usually saline water having a high density appears at a bottom layer portion of a river or the like, and fresh water having a low density appears at upper layer portion of a river or the like.

It is extremely difficult to exclusively and selectively discharge saline water having a high density in a bottom layer portion of a river or the like at a floodgate, because there is an increase or a decrease of incoming water at upstream side of the floodgate and there is also a change of sea water level due to tide at downstream side of the floodgate, so that water level or levels at the floodgate always changes. Pulling up of a tide-preventing floodgate is usually effected in such a situation that incoming water has been accumulated at upstream side of a floodgate and water level of a river is raised too much and there is a risk of damage due to flood of the river. Even in such a situation, when the gate is pulled up, sea water flows upstream, though comparatively small in quantity, from bottom portion of the opening of the gate, unless upstream water level is higher than downstream sea water level by a value $\Delta Hc$, as shown in FIG. 3.

A conventional tide-preventing floodgate is shown in FIGS. 1–3, wherein a floodgate 1 closes a waterway 2. Sea water 3 is on the right of the floodgate 1 and fresh water 4 is on the left of the floodgate 1. A density of sea water is $\rho_2$ and its depth is shown by $h_1$. A level $L_2$ of the sea water receives an influence of the tide and changes twice a day as shown by a curve L. Changes of sea water level $L_2$ varies depending on regions, day by day and season by season and fluctuates considerably. Incoming water flows from upstream to downstream of a river, a fresh water lake, a waterway or the like, and if water flowed into is left as it is, the water level $L_1$ of fresh water rises and there is flood damage, therefore, it is necessary to pull up the gate for draining. In this case, sea water flows upstream through the gate, if the level $L_1$ on the upstream side of the floodgate is not higher than the level $L_2$ of sea water by a level difference limit $\Delta Hc$ that prevents sea water from flowing upstream through the gate. The level difference limit $\Delta Hc$ is about 3% of the sea water depth $h_1$. If the gate is pulled up when the water level difference $\Delta H$ between the fresh water level $L_1$ and the sea water level $L_2$ is less than the level difference limit $\Delta Hc$, a situation occurs that a surface layer fresh water $H_1$ flows out through an upper part of the opening of the gate, while sea water 3a flows through a lower part of the opening of the gate into lower portion of upstream fresh water, thus forming a saline water layer $H_2$ having a density $\rho'_2$ as shown in FIGS. 3 and 4.

It is therefore necessary to operate a floodgate 1 by a supervisor with careful attention. However, where a ship fairway is arranged besides a tide-preventing floodgate, sea water flows upstream regardless of a supervisor's control when the ship fairway is opened. Therefore, heretofore, an ideal control of a floodgate has been very difficult, incomplete or very complicated. In addition, tide-preventing floodgates have often been constructed at remote or inconvenient places where no prime mover is applicable. Hence, a developing of an apparatus for automatically and selectively discharge saline water solely, without using a prime mover and without needing an operator, has been earnestly desired.

An object of the invention is, therefore, to provide an apparatus for automatically and selectively discharging saline water at a tide-preventing floodgate to preserve fresh water of a river or the like as much as possible to permit maximum effective utilization of fresh water resources.

Another object of the invention is to provide an apparatus for automatically and selectively discharging saline water at a tide-preventing floodgate at places where transportation is inconvenient or remote places.

Another object of the invention is to provide an apparatus for automatically and selectively discharging saline water without using a prime mover and without needing an operator.

Another object of the invention is to provide a cheap and simple apparatus for automatically and selectively discharging saline water.

A further object of the invention is to provide an apparatus for automatically and selectively discharging saline water at a tide-preventing floodgate to prevent a salt damage of upstream side areas of a river or the like due to saline water.

These and other objects of the invention will be made apparent from the following more particular description of the invention.

SUMMARY OF THE INVENTION

The object of the present invention is to provide an improved apparatus for automatically and selectively discharging saline water at a tide-preventing floodgate between the ocean and a river or the like. More particularly, the present invention relates to a field type apparatus for automatically and selectively discharging saline water at a tide-preventing floodgate between the ocean and a river or the like without using any prime mover and in the absence of a controller.

The apparatus according to the present invention, comprises, a tide-preventing floodgate provided between the ocean and river or the like, a partition wall provided on a lower portion or a side portion of said floodgate so as to separate fresh water of upstream side of the floodgate from sea water of downstream side of the floodgate, a drainpipe for discharging saline water of a lower portion of said river or the like and disposed on the lower part of said partition wall, a distal end mouth opened at an end portion of said drainpipe, a hollow float positioned at the distal end mouth of the drainpipe and provided with an air duct at its top and an opening at its lower portion, and at least one guide member provided near the hollow float for preventing large lateral displacement of the hollow float and guiding the ascending or descending motion of the hollow float, whereby said hollow float automatically ascends or descends so as to open or close said end mouth of the drainpipe when a level difference between upstream water level and downstream sea water level of the floodgate is larger or smaller than a level difference limit for discharging saline water of the bottom layer portion of the upstream side or preventing sea water of the downstream side of the floodgate from flowing into the upstream side of the floodgate.

DETAILED DESCRIPTION OF THE INVENTION

Figure 4:
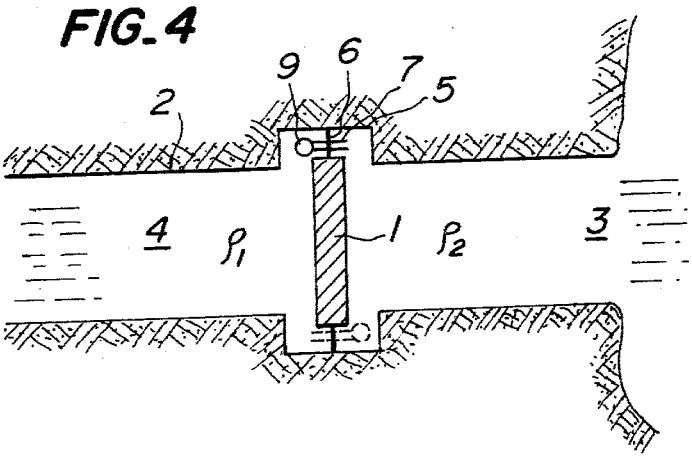

The drainpipe used in the present invention is provided at the utmost lower part of a partition wall. The word "the utmost lower part of a partition wall" herein means to include the utmost lower part of a partition wall per se and an extended wall of a partition or the floodgate, as well as an earth portion below an extended wall or partition of a floodgate. Preferably, a side bank of a river is recessed and a partition wall is extended from the floodgate to the recessed portion of the side bank and the drainpipe is arranged at the utmost lower part of the partition wall as shown in FIG. 4.

The hollow float used in the present invention can be any desired shape that can easily ascend or descend to clearly open or close the mouth of the drainpipe.

In a preferred embodiment, the upright end mouth of the drainpipe, the hollow float and the guide member are arranged at fresh water side of the floodgate, and the apparatus is further provided with a communication path arranged at the partition wall and a flexible communication pipe for communicating the opening of the hollow float with the communication path of the partition wall.

In a preferred embodiment, the hollow float is provided with a counterweight which is previously adjusted to such an apparent weight that, at a control level of fresh water, a floating power produced by a level difference between the upstream water level and the downstream sea water level maches with the apparent weight of the hollow float.

In a preferred embodiment, a screen is provided around said hollow float for preventing large floating dusts or rubbishes from adhering to the hollow float.

The screen is secured to the guide member, a plurality of poles for supporting thereof, the partition wall or the floodgate.

The screen used in the present invention has such a mesh size that can allow free path of water but can prevent large floating dusts or rubbishes from adhering to the hollow float and has a function to prevent adverse effect of waves or large lateral displacement of the hollow float.

The word "saline water" used herein means fresh water containing a relatively large amount of sea water or salt as compared to original fresh water of a river or the like, resulting from sea water.

The parts of the apparatus such as the outlet pipe, the hollow float, the guide member and the like are made of any desired material that can withstand to chemical deterioration to assure its long usage life, such as plastics, stainless steel or the like.

Figure 5:
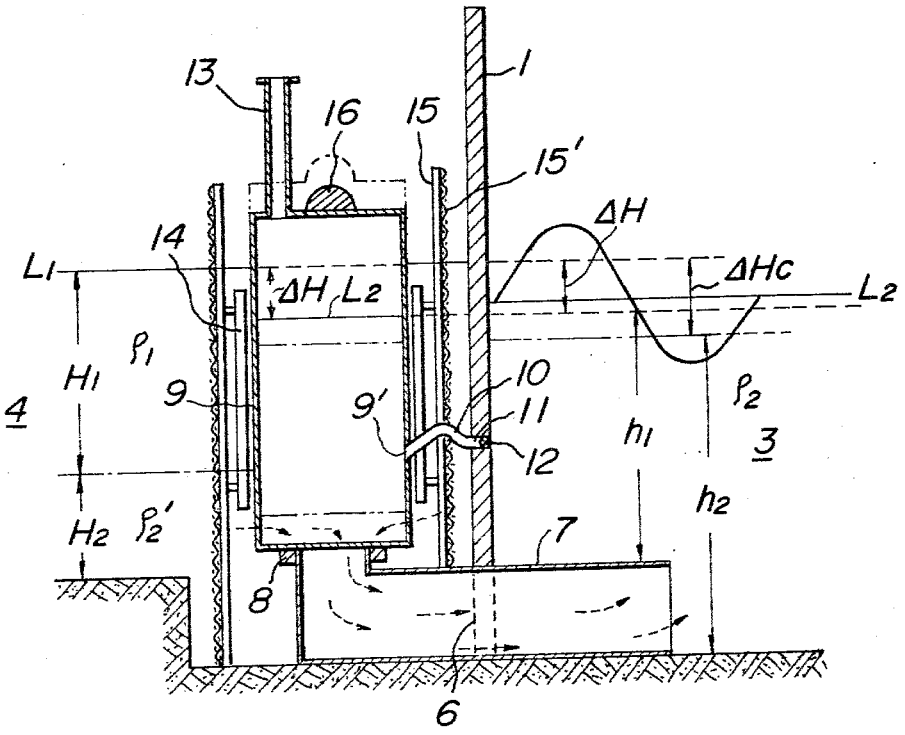

Preferably, the hollow float according to the present invention is provided at upstream side of a floodgate as shown in solid lines in FIGS. 4 and 5.

Figure 6:
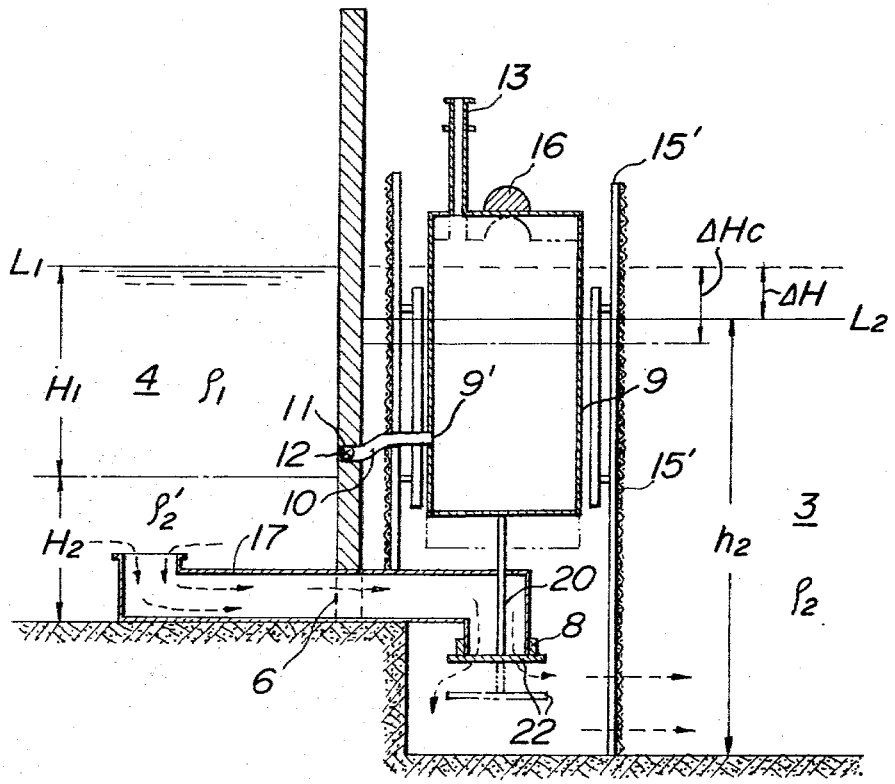
Figure 7:
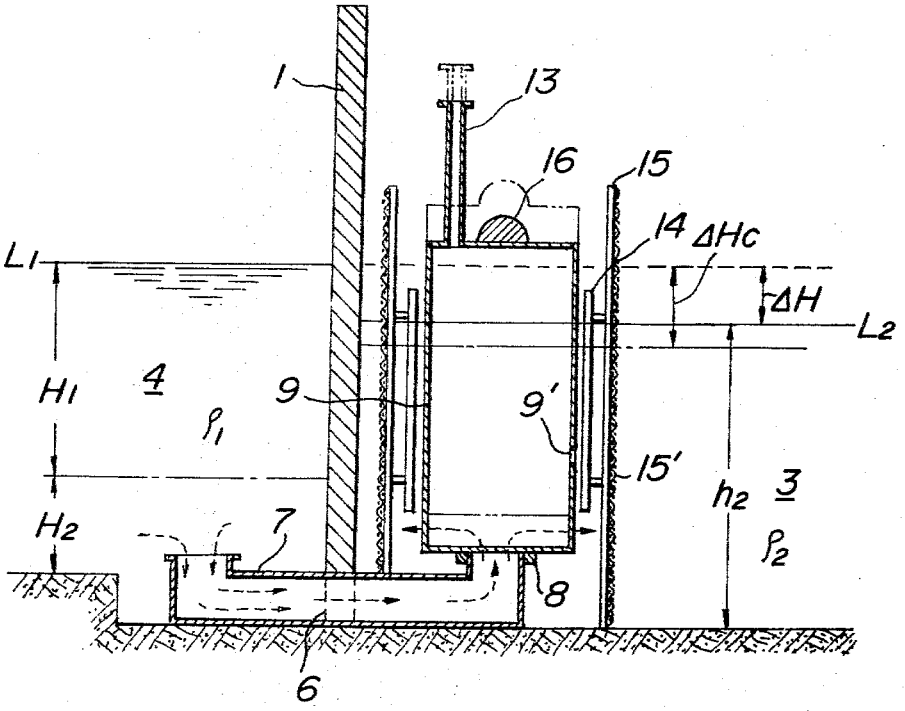

In another aspect of the present invention, the hollow float of the present invention is provided at downstream side of a floodgate as shown in phantom in FIG. 4 and as shown in FIGS. 6 and 7.

In such an aspect of the present invention, the distal end mouth of the drainpipe, the hollow float and the guide member are arranged at sea water side of the floodgate.

In a preferred embodiment, the distal end mouth of the drainpipe opens to upright direction, as shown in FIG. 7.

In a preferred embodiment, the apparatus is further provided with a communication path arranged at submarine level portion of the partition wall and a flexible communication pipe for communicating the opening of the hollow float with the communication path of the partition wall, and the distal end mouth of the drainpipe opens to downward direction, and the hollow float is provided with a rod at its lowest portion and a valve plate connected to the rod beneath the downwardly opened end mouth of the drainpipe for closing and opening the end mouth from beneath, as shown in FIG. 6.

Hereinafter, the invention will be explained in more detail with reference to the accompanying drawings which, however, should not be construed in any means as limitations of the invention.

Figure 1:
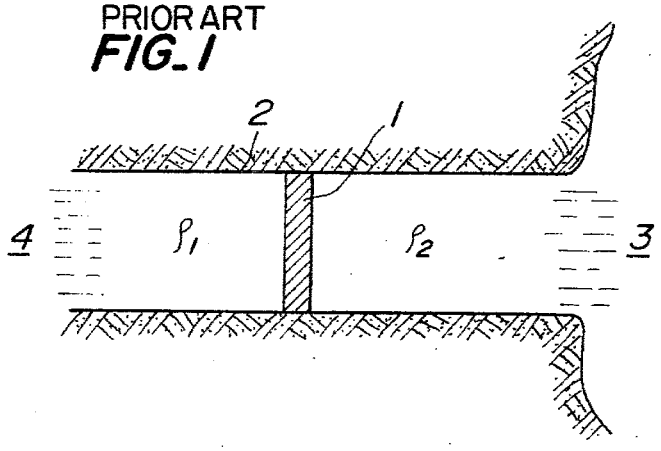
PRIOR ART FIG. 1
Figure 2:
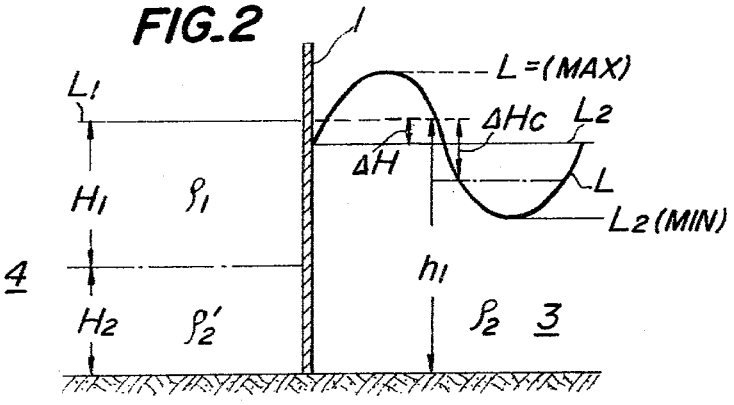
PRIOR ART FIG. 2
Figure 3:
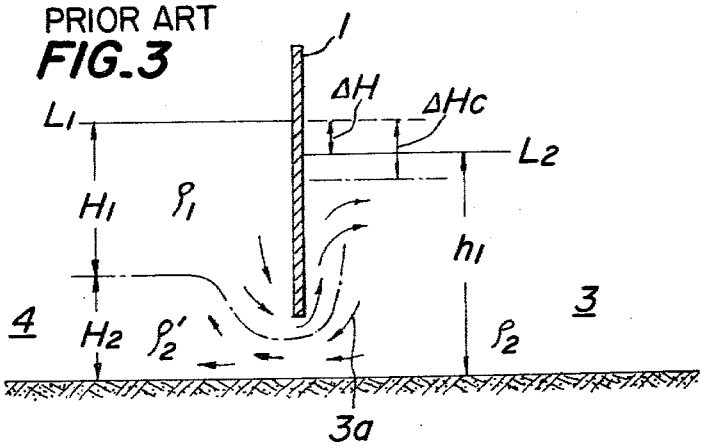
PRIOR ART FIG. 3

The brief description of the drawings is as follows:

FIG. 1 is a schematic plan view of a conventional tide-preventing floodgate,

FIG. 2 is a schematic cross-sectional side view of a conventional tide-preventing floodgate in a closed state for explaining its function, FIG. 3 is a schematic cross-sectional side view of the floodgate of FIG. 2 in an open state for explaining its function, FIG. 4 is a schematic plan view of a tide-preventing floodgate provided with an embodiment of the apparatus according to the present invention, FIG. 5 is a schematic cross-sectional side view of a tide-preventing floodgate provided with an embodiment of the apparatus according to an aspect of the present invention, FIG. 6 is a schematic cross-sectional side view of a tide-preventing floodgate provided with an embodiment of the apparatus according to the second aspect of the present invention, and FIG. 7 is a schematic cross-sectional side view of a tide-preventing floodgate provided with an embodiment of the apparatus according to the second aspect of the present invention.

In FIGS. 1 to 7, reference numeral 1 shows a tide-preventing floodgate arranged at a contact area between the ocean and a river, a fresh-water-lake or a waterway 2, for preventing entering of sea water and effectively utilizing water resources. Reference numeral 3 is sea water on downstream side of the floodgate 1 and reference numeral 4 is fresh water on upstream side of the floodgate 1. A cut off portion or recess portion 5 is formed at a side bank of a river or waterway 2. A floodgate 1 or its extended portion or a partition wall 6 is extended from a side bank to the other side bank or a recessed portion 5. A drainpipe 7 is provided at the utmost lower part of the floodgate 1 or the partition wall 6. Upstream end portion of the drainpipe 7 is an upright mouth 8. On the flat and smooth upper end surface of the end portion 8 is arranged a vertically movable cylindrical hollow float 9. The hollow float 9 is provided with an opening 9' at its lower portion and is coupled to a communication path 11 of the floodgate 1 or the partition wall 6 by means of a flexible soft communication pipe 10. The communication path 11 is arranged at a position where its downstream end opens into sea water and provided with a valve 12 for maintenance and supervision such as cleaning of the hollow float 9 or the like. The hollow float 9 has an air drain duct 13 on its top end. Water level inside of the hollow float 9 always shows a water level equal to the surface of sea water or fresh water that flows in or out through the opening 9' of the hollow float 9. The upper portion of the hollow float 9 is always present on the water surface and the air drain duct 13 is always protruded above water level $L_1$ or $L_2$. In order to prevent large lateral movement of the hollow float 9 and influence of waves and adhesion of dusts or rubbishes to the circumference of the hollow float 9, a cylindrical screen 15' is provided around the hollow float 9. The screen 15' is provided with two guide members 14 for guiding the ascending or descending motion of the hollow float 9. The screen 15' is secured to two poles 15 for supporting the screen, but the screen can alternatively be secured to the partition wall or to the floodgate.

The function of the apparatus according to the present invention will be explained as follows.

Almost all part of the hollow float 9 is in the water and a part thereof is projected on the water, so as to close or open the end portion 8 of the drainpipe 7 by an apparent weight W. Apparent weight w of a counterweight 16 is previously adjusted such that, at a control level of fresh water, a floating power F produced by a level difference ΔH between the upstream fresh water level and the downstream sea water level matches with the apparent weight W of the hollow float 9. By such construction, saline water on the upstream side is automatically and selectively discharged to the downstream side by the following functions.

(1) In case that the water level difference ΔH between the upstream water level and the downstream sea water level is smaller than the water level difference limit ΔHc that prevents sea water from flowing upstream (at high tide, in general); the floating power F acting on the hollow float 9 is expressed by the following euqation $$F=1\times\Delta H\times A \qquad (1)$$

wherein, A is a horizontal cross-sectional surface area of the hollow float 9.

Since $\Delta H<\Delta Hc$, it can be said that $F<W$. That is, the floating power F becomes smaller than the apparent weight W of the hollow float 9 and the hollow float 9 does not float and still closes the end portion 8 of the drainpipe 7 and prevents sea water from flowing upstream, but saline water is also not discharged. Such situation occurs generally at high tide.

(2) In case that the water level difference ΔH between the upstream water level and the downstream water level is larger than the water level difference limit ΔHc (at low tide, in general);

the floating power F acting on the hollow float 9 is given by the equation (1). Since $\Delta H>\Delta Hc$, it can be said that $F>W$. That is, the floating power F becomes larger than the apparent weight W of the hollow float 9 and the hollow float 9 ascends and floats to open the mouth 8 of the drainpipe 7 and selectively discharges exclusively saline water of the bottom layer of the river or the like, but does not discharge fresh water of the upper layer, thus obtaining an effect that saline water of the bottom layer portion of the river is solely and selectively and automatically discharged and removed.

Namely, by the above functions (1) and (2), the hollow float 9 is automatically operated by buoyancy depending on ascent or descent of the upstream water level of river or the like or ascent or descent of sea level by tide, and saline water of the bottom layer portion of the river or the like is exclusively and selectively discharged, so that the object of the desalting can be attained.

According to the second aspect of the present invention, the hollow float, the distal end mount of the drainpipe and the guide member are arranged as shown in phantom in FIG. 4 and as shown in FIGS. 6 and 7.

In a preferred embodiment as shown in FIG. 6, the drainpipe 7 has a downwardly opened distal end mouth 8, and the hollow float 9 is provided with a rod 20 at its lowest portion and a valve plate 22 is connected to the rod 20 beneath the end mouth 8. When ΔH is smaller than ΔHc, the valve plate 20 closes the end mouth 8. When ΔH is larger than ΔHc, a pressure of the upstream fresh water 4 which exerts a downward power on the upper surface of the valve plate 20 becomes larger than the floating power F of the hollow float 9 and the hollow float 9 descends to open the end mouth 8 of the drainpipe 7.

In a preferred embodiment as shown in FIG. 7, the communication pipe 10, the communication path 11 and the valve 12 are omitted and the opening 9' of the hollow float 9 opens to sea water. The apparatus functions similarly as in FIG. 5.

With the use of the apparatus according to the present invention, valuable fresh water is not wastefully discharged into the ocean and saline water of the bottom layer portion only is selectively discharged into the ocean, so that fresh water resources can effectively be utilized with no fear of injury of salt. Thus, the present invention is greatly advantageous in the industries concerned.

The desalting apparatus according to the present invention is remarkably effective in such cases that a bay tided in and out like Kojima Bay or Hachiro Tideland is closed to make it a fresh water lake, or a mouth of a river is embanked to construct an artificial fresh water lake and the like.

Though the present invention has been explained with reference to the case of providing two guide members for guiding the hollow float, the guide members may be omitted if the space between the hollow float and the screen is made narrow.

Although the present invention has been described in considerable detail with reference to certain preferred embodiments thereof, it will be understood that many variations and modifications can be effected without departing the broad spirit and aspect of the invention as described above and as defined in the appended claims.

What is claimed is:

1. An apparatus for automatically and selectively discharging saline water through a tide-preventing floodgate structure located between the ocean and a body of fresh water, said apparatus comprising:

a partition wall provided in said structure to separate fresh water upstream of said structure from sea water downstream of said structure, a drain pipe in a lower part of said wall connecting upstream and downstream sides of said wall for discharging saline water from a lower portion of said body of water into the ocean, means defining an upwardly open distal end mouth at one end of said drain pipe, a hollow float positioned above said distal end mouth of the drain pipe for opening and closing said mouth, said float having an air duct at its top and an opening in a lower portion of said float, means defining a communication path extending through a submerged portion of the partition wall between upstream and downstream sides of the structure, a flexible communication pipe connecting said opening in said hollow float with said communication path, and at least one guide member adjacent the hollow float for preventing large lateral displacement of the hollow float and guiding ascending or descending movements of the hollow float, whereby said hollow float automatically ascends or descends so as to open or close said end mouth of the drain pipe when a level difference between upstream fresh water and downstream sea water is larger or smaller than a level difference limit for discharging saline water in the lower portion of said body on the upstream side of the structure or preventing sea water from the downstream side of the structure from flowing to the upstream side of the structure.

2. The apparatus as defined in claim 1, wherein the distal end mouth of the drainpipe, the hollow float and the guide member are disposed on the fresh water side of the floodgate structure.

3. The apparatus as defined in claim 1, wherein the hollow float is provided with a counterweight which is adjusted to such an apparent weight that, at a control level of fresh water, a floating power produced by a level difference between the upstream water level and the downstream sea water level matches with the apparent weight of the hollow float.

4. The apparatus as defined in claim 1, wherein a screen is provided around said hollow float for preventing floating matter from adhering to the hollow float.

5. The apparatus as defined in claim 4, wherein said screen is secured to the guide member.

6. The apparatus as defined in claim 4, wherein said screen is secured to a plurality of poles for supporting.

7. An apparatus for automatically and selectively discharging saline water through a tide-prevening floodgate structure located between the ocean and a body of fresh water, said apparatus comprising:

a partition wall provided in said structure to separate fresh water upstream of the structure from sea water downstream of the structure, a drain pipe in a lower part of said wall connecting upstream and downstream sides of said wall for discharging saline water from a lower portion of said body of water into the ocean, means defining a downwardly open distal end mouth at one end of said drain pipe, a hollow float positioned above said one end of the drain pipe for opening and closing said mouth, said float having an air duct at its top, an opening in a lower portion of the float, a rod extending downwardly from the float and a valve plate connected to said rod beneath said downwardly open end mouth for closing and opening said mouth from below in response to ascending and descending movements of the float, means defining a communication path extending through a submerged portion of the partition wall between upstream and downstream sides of the structure, a flexible communication pipe connecting said open in said hollow float with said communication path, and at least one guide member adjacent the hollow float for preventing large lateral displacement of the hollow float and guiding ascending or descending movements of the hollow float, whereby said hollow float automatically ascends or descends so as to open or close said end mouth of the drain pipe when a level difference between upstream fresh water and downstream sea water is larger or smaller than a level difference limit for discharging saline water in the lower portion of said body on the upstream side of the structure or preventing sea water from the downstream side of the structure from flowing to the upstream side of the structure.

8. The apparatus as defined in claim 7, wherein the distal end mouth of the drainpipe, the hollow float and the guide member are disposed on the sea water side of the floodgate structure.

* * * * *

UNITED STATES PATENT AND TRADEMARK OFFICE

CERTIFICATE OF CORRECTION

PATENT NO. : 4,242,009

DATED : December 30, 1980

INVENTOR(S) : ISAO MINAMI

It is certified that error appears in the above—identified patent and that said Letters Patent is hereby corrected as shown below:

On the title page, Item [73] should read:

MICHIO OKAMOTO, PRESIDENT OF KYOTO UNIVERSITY, KYOTO, JAPAN

Signed and Sealed this

*Twentieth* Day of *October 1981*

[SEAL]

*Attest:*

GERALD J. MOSSINGHOFF

*Attesting Officer*

*Commissioner of Patents and Trademarks*